US005806392A

United States Patent [19]

Cleall et al.

[11] Patent Number: 5,806,392

[45] Date of Patent: Sep. 15, 1998

[54] PRODUCING SHAPED ARTICLES

[75] Inventors: Andrew John Cleall; James Goodwin, both of Coventry; Geoffrey William Vernon, High Wycombe; Peter Ernest Willett, Buckinghamshire, all of England

[73] Assignee: Thomas J. Lipton, Co., Division of Conopco, Inc., Englewood Cliffs, N.J.

[21] Appl. No.: 832,129

[22] Filed: Apr. 3, 1997

Related U.S. Application Data

[63] Continuation of Ser. No. 496,346, Jun. 29, 1995, abandoned.

[30] Foreign Application Priority Data

Jul. 1, 1994 [EP] European Pat. Off. ..... 94304864

[51] Int. Cl.[6] ..... B26D 7/00

[52] U.S. Cl. ..... 83/155; 83/155.1; 83/113; 83/116

[58] Field of Search ..... 83/155, 155.1, 83/150, 161, 107, 113, 115, 116, 117, 118, 119, 120, 346, 347, 663; 53/134.2

[56] References Cited

U.S. PATENT DOCUMENTS

| | | | |
|---|---|---|---|
| 880,465 | 2/1908 | Price | 83/116 X |
| 1,738,076 | 12/1929 | Molins | 83/116 |
| 1,782,674 | 11/1930 | Baumgartner | 83/115 |
| 2,318,173 | 5/1943 | Luehrs | 83/107 |
| 2,318,953 | 5/1943 | Meyer | 83/161 X |
| 2,499,570 | 3/1950 | Crafts | 83/107 |
| 2,881,836 | 4/1959 | Thiem et al. | 83/25 |
| 3,348,442 | 10/1967 | Eberman et al. | 83/318 |
| 3,521,512 | 7/1970 | Woessner | 83/107 |
| 3,762,252 | 10/1973 | Hujer et al. | 83/167 X |
| 3,834,291 | 9/1974 | Bishop | 83/103 X |
| 4,108,033 | 8/1978 | Bembenek | 83/167 X |
| 4,270,910 | 6/1981 | Himmelsbach | 83/107 X |
| 5,233,813 | 8/1993 | Kenney et al. | 53/450 |
| 5,363,728 | 11/1994 | Elsner et al. | 83/116 X |

FOREIGN PATENT DOCUMENTS

| | | |
|---|---|---|
| 1589879 | 5/1970 | France . |
| 2532586 | 3/1984 | France . |
| 2733626 | 2/1979 | Germany . |
| 1501399 | 2/1978 | United Kingdom . |
| WO 90/13487 | 11/1990 | WIPO . |
| WO 92/14649 | 9/1992 | WIPO . |

OTHER PUBLICATIONS

International Search Report in International Patent Application No. PCT/GB 95/01539.

*Primary Examiner*—Maurina T. Rachuba
*Attorney, Agent, or Firm*—James J. Farrell

[57] ABSTRACT

Shaped articles are cut from a web by correspondingly shaped cutters on a drum cooperating with an anvil drum. The web is engaged by conveyor bands which pass around the cutter and anvil drums and form a continuing conveying path for the web away from the drums. The conveyor bands are clear of the article shapes cut in the web which can thus be positively separated from the web by pusher means to be drawn away from the web by their own conveying means.

17 Claims, 2 Drawing Sheets

PRODUCING SHAPED ARTICLES

This is a continuation application of Ser. No. 08/496,346, filed Jun. 29, 1995, now abandoned.

BACKGROUND OF THE INVENTION

This invention relates to the production of packets from a double-walled, eg. tubular, web and is concerned particularly with the formation and separation of packets from the web when the required profile of the packets leaves a part of the web as waste.

It is well known to seal and sever a tubular web at intervals along its length to produce rectangular packets. If another shape of packet is required—eg. circular—it can be formed by correspondingly shaped sealing and cutting means acting on the web but a ribbon of the web material will be left as waste which must be disposed of without interfering with the further processing of the packets.

This can be a problem when sealing and cutting thermoplastic materials such as paper-plastic mixtures used for tea bags in a flow line operation, in particular at high rates of production, because it cannot be ensured that the packets will separate cleanly from the web in the severing operation as the cutters begin to wear. If the surplus web material is drawn off to waste there is a risk that production will be lost because packets remaining will also be attached to the web drawn off. WO90/13487 describes an arrangement in which shaped tea bags are stamped from the web after being severed, but if force must be used, eg. because of loss of efficiency in the severing operation, the web may be overloaded.

The method of separating profile shapes cut in a web at a station in the path of the web downstream of the station at which those shapes are cut is also known from U.S. Pat. Nos. 3,834,291 and 2,881,836 and FR 1589879.

SUMMARY OF THE INVENTION

In one of its aspects the present invention provides apparatus for cutting shaped articles from an elongate web comprising a circulating cutter arrangement, a plurality of profiled cutters mounted in said arrangement for severing the shapes of said articles in the web, and means for drawing the web past said cutter arrangement, means in said cutter arrangement associated with each said profiled cutter and movable apparatus for cutting shaped articles from an elongate web comprising a circulating cutter arrangement, a plurality of profiled cutters mounted in said arrangement for severing the shapes of said articles in the web, and means for drawing the web past said cutter arrangement, means in said cutter arrangement associated with each said profiled cutter and movable through the profile area of the article to separate at least a portion of the article from the web, and draw-off means for the articles arranged to engage each article before it has been completely separated from the path of the web.

By arranging that the article conveying means engage each article before it has been completely separated from the path of the web, because the separation of the articles from the web is assisted.

Preferably, there are further draw-off means for the web, the respective draw-off means leading the shaped articles and the waste web from which the articles have been cut to different paths extending away from said cutter arrangement.

According to a further aspect of the present invention, an apparatus for cutting shaped articles from an elongate web comprises a circulating cutter arrangement having shaped cutter means for severing the shapes of said articles in said web, separating means extendable through the cutting means to urge the articles away from said means and separate them from the web, and respective conveying means to transport the articles and the waste web on respective exit paths after said severing of the articles.

The separating means are preferably arranged to begin their operation while a profile is being severed. It is also preferred to arrange that they bring the articles into engagement with their conveying means before the profiled cutting of the articles have been completed, and thus before each article has been fully separated from the path of the remainder of the web.

According to yet another aspect of the invention, there is provided a method of cutting shaped articles from an elongate web employing at least one profiled cutter in a circulating cutter arrangement wherein the web is drawn past said cutter arrangement as said articles are cut, and portions of the articles severed by the cutter arrangement are pushed from the web and are drawn away from the cutter arrangement before the respective articles have been completely severed from the web.

Examples of the invention will be described in more detail by way of example with reference to the accompanying schematic drawings.

DESCRIPTION OF THE PREFERRED EMBODIMENTS

Figure 1:
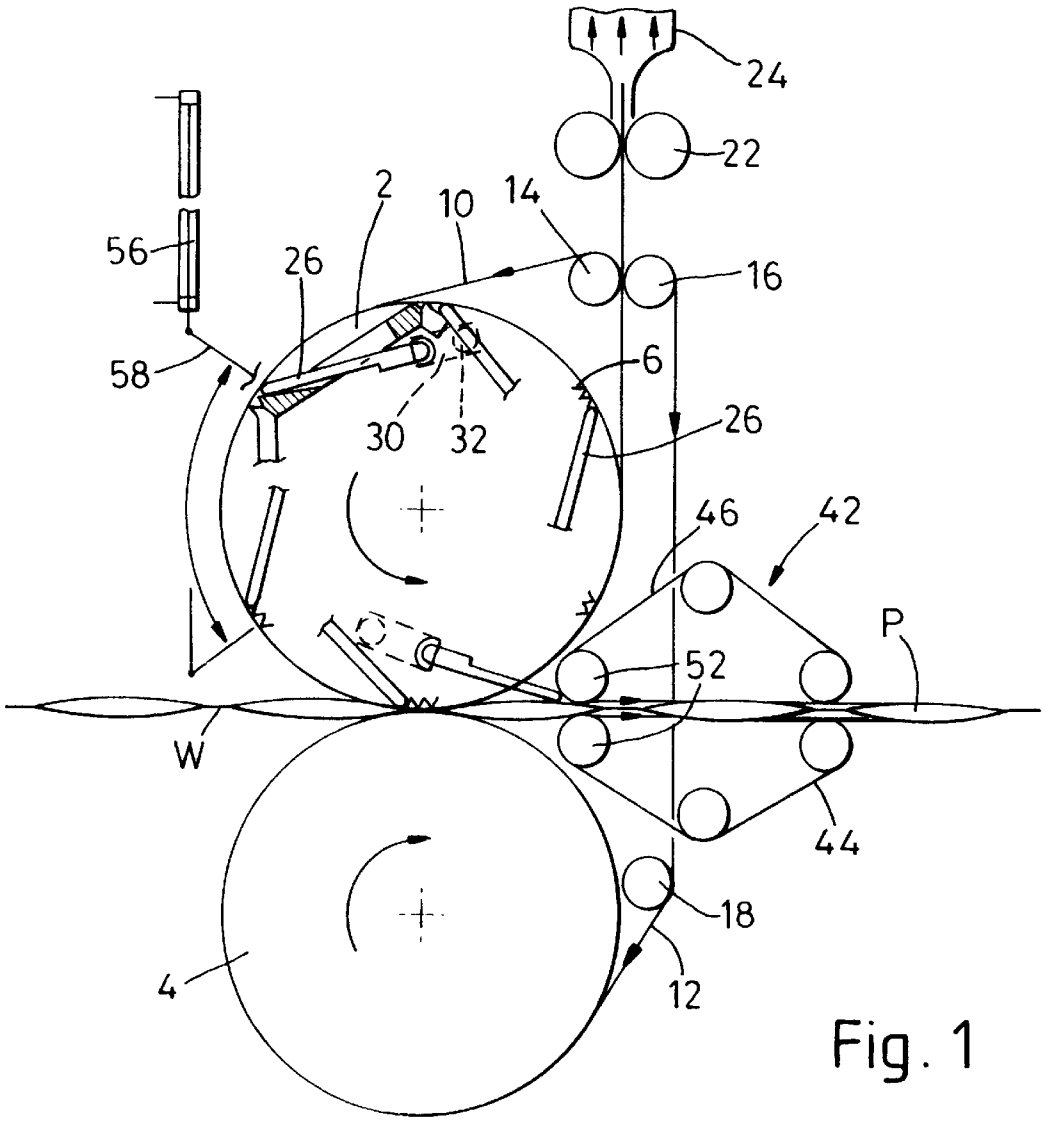

Referring to FIG. 1, a cutter arrangement of the apparatus has a circulating cutter arrangement comprising a cutter drum 2 and an opposed anvil drum 4, rotating on parallel axes, between which is fed a double-layer web W of plastics or paper. The web W has doses of a soluble or infusible material encapsulated between the layers at regular intervals along its length by means of heat seals (not shown) between the layers. The cutter drum is provided with a series of profiled cutters in the form of ring cutters 6 (indicated fragmentarily only in FIG. 1 (for clarity) to sever the profile area shapes of individual packets P from within the width of the web W along boundaries lying within the heat seals, each containing a dose of the soluble material. The ring cutters 6 each have a profile that is clear of an edge margin at least at one side of the web to maintain the continuity of the web, but preferably the profiles of the cutters are spaced from both side edges of the web.

The web, which thereby runs as a continuous strip also after the packets have been severed from it, is drawn off by pairs of conveyor bands 10,12 driven by the drums 2,4 which extend around the cutter drum 2 and anvil drum 4 respectively. The bands of each pair 10,12 are laterally offset to opposite sides of the drums 2,4, out of the path of the cutters 6. The bands 10 pass around the cutter drum 2 and a roller 14. The bands 12 pass around the anvil drum 4 and rollers 16,18. In their run between the nip of the drums 2,4 and the rollers 14,16, the bands 10,12 follow the same track and grip the margins of the web between them to act in this embodiment as conveying means for drawing the web between the drums 2,4 and also for drawing the waste web, after the severing of the packets, upwards from the cutter drum, away from the exit path followed by the packets P, described below. A pair of drive rollers 22 may be arranged further along the web exit path to maintain the web in tension before it enters a suction box 24 to be deposited in a waste container. The rollers 22 can serve as an alternative to the bands, however, as will be further described below.

It is not possible to ensure that the severed packets P separate from the web spontaneously as the web is carried upwards by the bands 10,12. In order to separate the packets positively and ensure they do not remain caught in the web, each cutter 6 has associated with it separating means which in this embodiment comprises a pusher member in the form of a rod 26 secured to a pivot shaft 28 which is mounted in bearings (not shown) in the cutter drum 2 parallel to the axis of rotation of the cutter drum. One end of each shaft 28 projects laterally from one side of the cutter drum 2 and has fixed to it a crank arm 30 which carries a follower roller 32 on its free end. A stationary cam ring 34 at the side of the cutter drum 2 has a closed-path cam track 36 formed in it to receive the follower rollers 32 of the crank arms 30, the cam ring and follower means providing means for extending the pusher rods 26 into the path of the web.

The cam track 36 is so shaped that as the drum 2 rotates the pusher rods 26 are pivoted inwardly and outwardly. They are pivoted inwards to lie inside the periphery of the cutter drum 2 over the greater part of its rotation but swing outwards at a predetermined region in the rotary path of the cutter drum 2, namely after passing the pinch point between the drums 2,4, to move through the profile area shape of the associated severed packet in the web and so press the leading portion of the that severed packet from the web and into the nip of packet conveyor 42 which acts as draw-off means to draw the packet away from the drums. The conveyor 42 comprises a lower belt 44 extending across the width of the packet and a pair of spaced upper belts 46 engaging its side margins and between which the pusher rods 26 move. Opposed pairs of rollers 52 of the conveyor 42 bring the upper and lower belts 46,44 together to guide and grip the packets between them.

There are thus respective conveying means provided by the web conveying means or bands 10,12 and the packet conveyor 42, for drawing the waste web and the packets along respective exit paths from the circulating cutter arrangement.

It will be seen from FIG. 1 that the leading end of each packet P has already been inserted between the rollers 52 of the packet conveyor before the severing of the profile area shape of that packet has been completed. The packet is therefore always positively entrained. This also has the effect that, if there is any tendency of the rear portion of the packet to remain with the web, the packet conveyor will apply a separating force to the packet. Similarly, because the waste web is held between the bands 10,12, it is always drawn positively away from the packet exit path with minimal tension.

In the mode of operation described, each rod 26 is retracted into the periphery of the cutter drum 2 within approximately a quarter revolution of the drums 2,4 from their nip at the lowermost point of the cutter drum periphery.

However, it may be required, eg. for purposes of adjustment of the apparatus and the preceding or following stages of the associated manufacturing and packaging installation, to prevent packets being pushed into the conveyor 42. For this purpose the cam ring 34 is mounted on a rotary housing 54 coaxial with the cutter drum to be displaceable on the rotary housing by adjustment means. In this embodiment the adjustment means comprises a pneumatic cylinder 56 is connected by a lever 58 to the cam ring 34 and can rotate the cam ring through some 90° on the housing 54. The movements of the pusher rods 26 are accordingly displaced to a peripheral sector of the cutter drum 2 so that each arm now moves out of the periphery of the drum 2 only after it has moved beyond that sector in which the band 10 is in contact with the drum 2. That is to say, the rods 26 are kept from the web path when the cam ring 34 is so adjusted. It is also possible to arrange that the cam ring 34 is adjusted manually.

Although reference has been made to driving the conveyor bands 10,12 by the drums 2,4, it may be preferred to have a separate drive for the bands. This drive is preferably additional to the drive provided by the rollers 22 which act on the unsupported waste web and may be transmitted through the rollers 14,16. It is then possible to drive the conveyor bands 10,12 at a slightly faster rate than the drums 2,4, allowing some slippage on their tracks on the drums, to assist tracking of the web past the drums.

Figure 2:
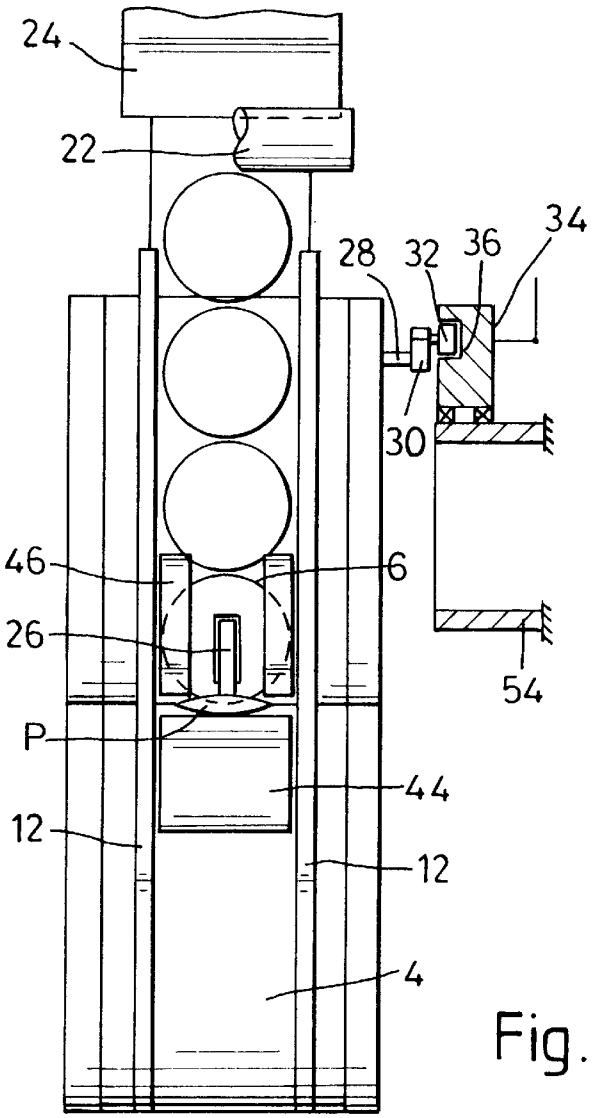
FIGS. 1 and 2 are side and end views, respectively, of an apparatus according to one embodiment of the invention.
Figure 4:
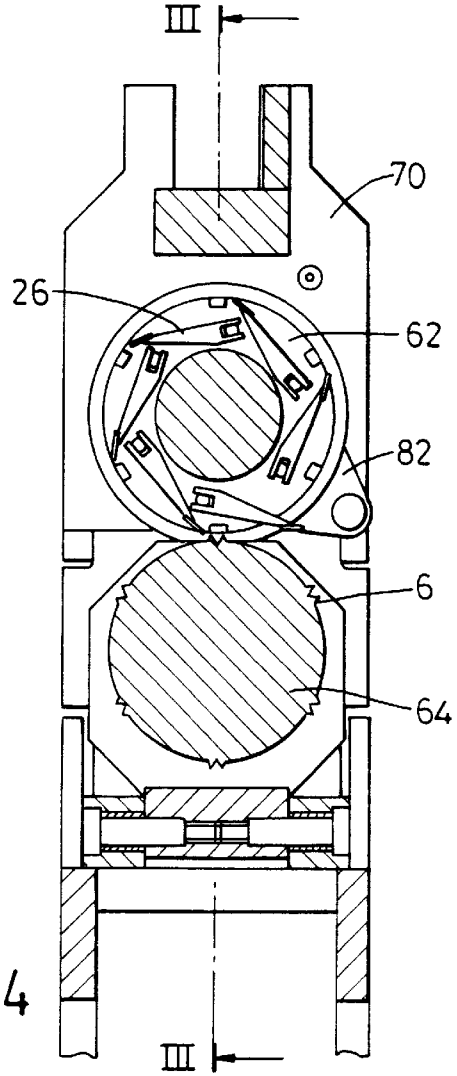
FIGS. 3 and 4 are axial and radial sectional views on the lines III—III in FIG. 4 an IV—IV in FIG. 3 respectively of a modified form of the apparatus.
Figure 3:
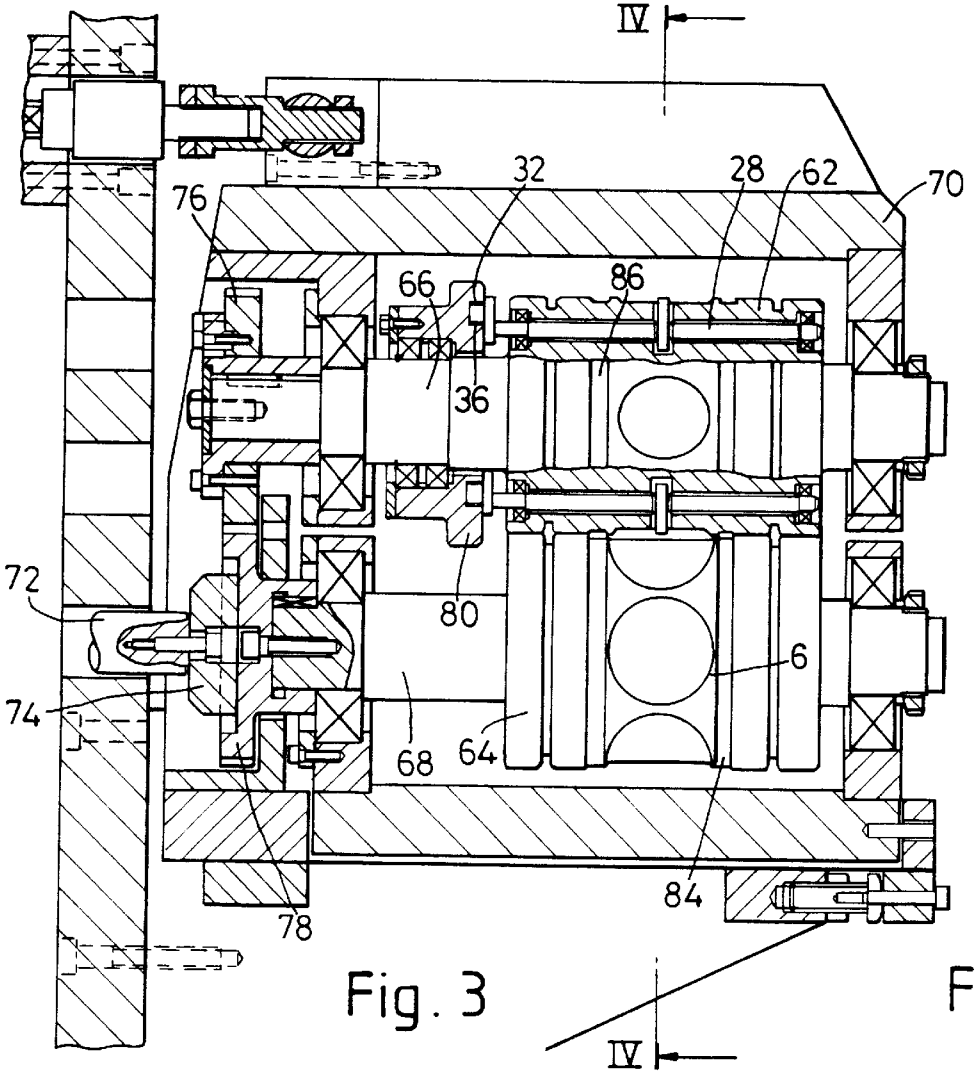

The embodiment illustrated in FIGS. 3 and 4 is similar in many respects to the embodiment of FIGS. 1 and 2, and parts already described are indicated by the same reference numbers.

A circulating cutter arrangement comprising anvil and cutter drums 62,64, respectively, are rotatable on parallel shafts 66,68 mounted in a fixed housing 70. An input drive 72 has a dog coupling 74 with the shaft 68 of the drum 64 and the shafts 66,68 are connected by gears 76,78 to rotate synchronously. In this embodiment synchronous rotation of the drums is required because the shape cutters 6 and the pusher rods 26 are on different drums, and must be kept in registration.

The pusher rods 26 are secured to the shafts 28 mounted in the anvil drum 62 in the manner described in the first embodiment and their projecting portions are in those areas of the anvil drum 62 which correspond or mate with the ring cutters 6 on the cutter drum 64. They are thus extended through the profile area shapes in the web of the articles being severed, as do the pusher rods in the first example. For this movement, the pusher rods 26 have their follower rollers 32 located in the track 36 in a cam disc 80 mounted on the shaft 66 independently of the rotation of the shaft. A lug 82 on the cam disc is connected to a control member (not shown) corresponding to the pneumatic cylinder 56 to displace the movement of the pusher rod 26 to and from the operative position in the manner already described. FIG. 3 also shows the tracks 84,86 in the drums 64,62, respectively, for the conveyor bands 10,12 (but not the bands themselves), the means for take-off of the waste web and the separated products being as already described.

An apparatus generally similar to that already described can be employed to put the packets into individual envelopes. The web W is now formed from a suitable outer packaging material and the doses to be encapsulated are replaced by the packets P themselves. Because the outer packaging of packets such as tea bags is commonly made of a more robust material than the packets themselves, there is less risk of rupture of the waste web although there is still the need to ensure clean separation of the product from the waste web. In these circumstances it is possible to dispense with the conveyor bands 10,12 and rely on the drive rollers 22 to draw the waste web away. In the manner already described, the rollers 22 can have a slightly faster peripheral speed than the drums 62,64 to assist the tracking of the web.

We claim:

1. An apparatus for cutting shaped articles from an elongate web, said apparatus comprising: a circulating cutter arrangement; at least one profiled cutter in said circulating cutter arrangement, said at least one profiled cutter defining a profile area shape for said shaped articles; said at least one profiled cutter severing the profile area shapes of said articles in the web, conveying means for moving the web on a path past said circulating cutter arrangement as said at least one profiled cutter severs said profile area shapes, separating means in said circulating cutter arrangement located adjacent to said at least one profiled cutter, said separating means being arranged to be moved, through the path of the web within the profile area shape of the article being severed by said at least one profiled cutter for separating away from the web at least a portion of said article being severed and article conveying means disposed adjacent to the path of the web for engaging each said article being severed before said article has been completely separated away from the web and drawing off said article.

2. An apparatus according to claim 1, wherein said article conveying means is located adjacent to said at least one profiled cutter for engaging each article while said at least one profiled cutter severs the profile area shape of said article in the web.

3. An apparatus according to claim 1, wherein the web conveying means and said article conveying means for drawing off the articles define respective paths extending away from said circulating cutter arrangement for the shaped articles and for waste web remaining from the web from which the articles have been cut.

4. An apparatus according to claim 1, wherein the separating means located adjacent to said at least one profiled cutter comprises a pusher member and, the apparatus further comprising a drive mechanism for said pusher member, said drive mechanism displacing said pusher member relative to said at least one profiled cutter to extend said pusher member to a position separating away from the web said portion of the article being severed.

5. An apparatus according to claim 4, wherein the drive mechanism comprises adjustment means for extending said pusher member at different regions of the cutter arrangement selectively the drive mechanism thereby selectively extending the pusher member at a region at which the article is being severed from the web or at an alternative region where the web is spaced from said circulating cutter arrangement the latter said region being selectable in order to render said pusher member inoperative on the web.

6. An apparatus according to claim 5 wherein the article conveying means for drawing off the shaped articles comprises a conveyor, and the extending of said pusher member by the drive mechanism at said first predetermined region displaces the shaped articles towards said conveyor.

7. An apparatus according to claim 1, wherein the circulating cutter arrangement comprises a rotary drum having a peripheral face on which is located said at least one profiled cutter (on its periphery) for severing the profile area shapes of said articles in the web.

8. An apparatus according to claim 1, wherein the web conveying means are arranged to grip the web through at least one region of the web laterally offset from said profile shapes of the articles in the web and to draw onwards from said circulating cutter arrangement waste web remaining after the severing of said profile area shapes.

9. An apparatus according to claim 1, wherein the web comprises opposite side regions and the web conveying means comprises at least one pair of conveyor bands, at least one said lateral margin being engaged by said pair of conveyor bands over at least a part of a path of the web through said circulating cutter arrangement, said pair of conveyor bands having a run extending away from said circulating cutter arrangement to convey away from said circulating cutter arrangement waste web remaining after the severing of said profile area shapes.

10. An apparatus according to claim 1, wherein the web comprises an intermediate region in which the shaped articles are formed, and side edge regions on opposite sides of said intermediate region, and the conveying means comprises pairs of web conveyor bands between which said side edge regions are gripped while leaving said intermediate region free.

11. An apparatus for cutting shaped articles from an elongate web comprising a circulating cutter arrangement, cutting means on said circulating cutter arrangement for severing profile area shapes of said articles in said web, said web having a width from part of which said shaped articles are severed, web conveying means for drawing the web through the circulating cutter arrangement as said cutting means sever said profile area shapes, said web conveying means being laterally offset from said cutting means for engaging the web laterally beyond that part of the width of the web from which said shaped articles are severed, and separating means in the circulating cutter arrangement for moving through the web within the profile area shapes of the articles severed by said circulating cutting arrangement, for separating the articles from the web.

12. An apparatus according to claim 11, wherein the circulating cutter arrangement comprises a rotary cutter drum having a peripheral face, at least one profiled cutter on said peripheral face, said cutter having a closed cutting profile, a counter-rotary anvil drum having a peripheral face against which said profile cutter presses the web, said separating means being located within one of said rotary cutter drum and counter-rotary anvil drum for displacement through the peripheral face of the drum within which it is located to project from said peripheral face of the drum when separating an article from the web.

13. An apparatus for cutting shaped articles from an elongate web comprising a circulating cutter arrangement, cutting means in said circulating cutter arrangement for severing profile area shapes of said shaped articles in said web, separating means within said circulating cutter arrangement, a drive mechanism for displacing the separating means for urging the articles away from the web whereby to separate the shaped articles severed from the web, respective exit paths extending from the circulating cutter arrangement for the articles and waste web remaining after said severing of the articles, and respective conveying means for transporting the articles and the waste web from which the articles have been severed along said exit paths.

14. An apparatus according to claim 13, wherein the article conveying means for transporting the articles severed from the web engage each article before completion of said severing of the profile area shape of the article.

15. A method of cutting shaped articles from an elongate web, said method employing a plurality of profiled cutters in a circulating cutter arrangement, comprising the steps of drawing the web past the cutter arrangement while severing the articles from the web, pushing a severed portion of each article from the web before the article has been completely severed from the web, and engaging said severed portions of the articles pushed from the web to draw the articles severed from the web away from the cutter arrangement.

16. A method according to claim 15, wherein the web from which the articles have been severed is drawn off on an exit path and said engaged severed portion of each article is drawn onto a separate exit path diverging from said exit path of the web before the article has been completely severed from the web.

17. An apparatus for cutting shaped articles from an elongate web, said apparatus comprising a circulating cutter arrangement, at least one profiled cutter in said circulating cutter arrangement defining a profile area shape for said shaped articles, conveying means for drawing the web on a path through said circulating cutter arrangement, said at least one profiled cutter moving in synchronism with said conveying means for severing said shaped articles from the web as it is drawn through the circulating cutter arrangement, separation means in said circulating cutter arrangement, displacement means for moving said separation means through the path of the web within the profile area shape of each article in the web for urging away from the web at least a portion of each said article during the severing of the article by said at least one profile cutter, and draw-off means disposed adjacent the path of the web for engaging the portion of said article urged away from the web while said at least one profiled cutter is severing the article.

* * * * *